US006704945B2

(12) United States Patent
Bellmore

(10) Patent No.: US 6,704,945 B2
(45) Date of Patent: Mar. 16, 2004

(54) DUAL INLET FLUSH VALVE SYSTEM FOR GRAVITY OPERATED TOILETS

(76) Inventor: Danny J. Bellmore, 6336 Grayson St., Englewood, FL (US) 34224

( * ) Notice: Subject to any disclaimer, the term of this patent is extended or adjusted under 35 U.S.C. 154(b) by 0 days.

(21) Appl. No.: 09/834,665

(22) Filed: Apr. 13, 2001

(65) Prior Publication Data

US 2002/0148037 A1 Oct. 17, 2002

(51) Int. Cl.[7] ..... E03D 1/14
(52) U.S. Cl. ..... 4/326
(58) Field of Search ..... 4/324, 325, 326, 4/327, 364, 363, 346, 345; D23/309, 295

(56) References Cited

U.S. PATENT DOCUMENTS

| | | | | | |
|---|---|---|---|---|---|
| 3,487,476 | A | * | 1/1970 | Stiern et al. | 4/326 |
| 3,768,103 | A | * | 10/1973 | Robinson | 4/326 |
| 3,795,016 | A | * | 3/1974 | Eastman | 4/326 |
| 4,175,295 | A | | 11/1979 | Cameron | 4/327 |
| 5,003,644 | A | | 4/1991 | Huang | 4/324 |
| 5,042,096 | A | | 8/1991 | Bolli | 4/326 |
| 5,121,510 | A | * | 6/1992 | Ricalde Medina | 4/326 |
| 5,230,103 | A | | 7/1993 | Antunez | 4/404 |
| 5,261,129 | A | * | 11/1993 | Roy | 4/326 |
| 5,381,561 | A | * | 1/1995 | Carson, III | 4/326 |
| 5,390,375 | A | | 2/1995 | Fernstrum, Jr. | 4/404 |
| 5,469,585 | A | * | 11/1995 | Shiue | 4/326 |
| D370,721 | S | | 6/1996 | Hewson | D23/309 |
| 5,603,128 | A | | 2/1997 | Nichols-Roy | 4/325 |
| 5,813,059 | A | | 9/1998 | Wang | 4/325 |
| 5,887,292 | A | * | 3/1999 | Goren | 4/363 |
| 5,966,749 | A | | 10/1999 | Goesling et al. | 4/392 |
| 6,041,452 | A | | 3/2000 | Hsiao et al. | 4/326 |

* cited by examiner

*Primary Examiner*—Gregory Huson
*Assistant Examiner*—Huyen Le
(74) *Attorney, Agent, or Firm*—Gifford, Krass, Groh, Sprinkle, Anderson & Citkowski, P.C.

(57) ABSTRACT

A flush valve system is constructed of a single housing having at least two inlets fluidly connecting a single outlet. Preferably, the system includes a flush handle assembly having at least two handles mechanically connected to and at least two linkages. Both linkages pass through a sleeve assembly, which mounts in the standard mount hole provided on conventional gravity flush toilet tanks to provide effective control for the dual inlet flush valve. The inlets are sealed with a primary and a secondary flapper valve that are preferably connected by a chain or other link to the at least two linkages. This system permits the user to conserve water by selective flushing of a large or small volume of water.

20 Claims, 6 Drawing Sheets

DUAL INLET FLUSH VALVE SYSTEM FOR GRAVITY OPERATED TOILETS

BACKGROUND OF THE INVENTION

1. Field of the Invention

The present invention relates to plumbing installations. More particularly, the invention concerns a dual flush system for a gravity flush toilet having an improved flush control apparatus.

2. Reference to Related Art

For many decades, household toilets have used a generally rectangular porcelain tank mounted above a porcelain bowl from which about 3.5 to 8 gallons of water are rapidly drained to flush waste from the bowl into a sewer system. One very common toilet design uses a silicon flapper that covers a single drain outlet located at the bottom of the tank. When a flush handle on the outside of the tank is manually depressed, the flapper valve is lifted and a modest pressure head of water in the tank empties through the drain outlet into the bowl. Typically, the flapper valve includes an inverted air chamber so that it initially floats as it is lifted away from the drain outlet. This floating flapper valve permits water to flow into the bowl even if the user immediately releases the flush handle. As the body of water flows through the drain outlet of the tank, it starts the siphoning action in the bowl and flushes the standing water in the bowl along with its waste contents into the sewer line.

A method for refilling the bowl and tank is also taught by the prior art. A ball cock valve or toilet tank fill valve mounted in the tank is connected to a pressurized water line in the house. When the tank drains, a float ball connected to the ball cock valve descends. The decent of the float ball opens the ball cock valve and begins the refilling of the tank.

When the tank is nearly empty, the flapper valve closes. The tank continues to fill as the float ball connected to the ball cock rises. At the same time, water from the ball cock valve enters an overflow tube to refill the bowl to a normal standing water level. Once the float ball reaches a predetermined height indicating the tank is full, the ball cock valve will close.

Water shortages throughout significant portions of the United States have forced major water conservation efforts. Conventional household toilets are wasteful and inefficient since a relatively large quantity of water is used to accomplish every flush. Therefore, various approaches have been employed in regions where water conservation is necessary to reduce water consumption by conventional toilets.

These efforts have led to improvements in toilets, such that as little as 1.6 gallons of water is utilized for a standard flush. However, this design is inefficient because while solid waste requires 1.6 gallons of water to accomplish the flush, liquid waste only requires enough water to replace the contaminated water in the bowl to complete the flush.

Additional approaches have included lowering the tank level or introducing a brick or dam to decrease the water volume released during each flush.

Yet another approach has been the development of a reduced flow (water saving) flapper valve that is designed with a vent in the air chamber portion of the flapper. The typical flush valve assembly (as discussed above) includes a single flapper valve having a normally downward opening air chamber which acts as a float when the flapper is raised off its seat to hold the flapper valve open when water is in the tank. A reduced flow flapper allows air to escape when in the open position allowing a rapid descent of the flapper. Therefore, the inlet is sealed before the entire contents of the tank are emptied into the bowl and the amount of water dispensed during each flush is effectively decreased. This approach has also been generally unsatisfactory because the consequent reduction in water flow into the bowl often results in incomplete flushing of solid waste. Users then flush twice, compounding the waste of water.

Still another approach for conserving water in toilets has been the use of multi-level flush valves. These valves comprise one inlet at or near the base of a toilet tank for long (solid waste) flushes and another inlet set at a higher elevation in the tank for short (liquid waste) flushes. Such devices depend on the depth of the water to be consistent within the tanks in which they are installed. However, in view of the variety of toilet designs available, each having a different shape or size tank, this approach is ineffective.

Accordingly, it is desirable that an improved dual flush apparatus be available which is simple, effective and adaptable for use in a variety of tank shapes and sizes while adequately providing for both long and short flushes of a toilet, with maximum efficiency for the volume of water used.

SUMMARY OF THE INVENTION

A dual inlet flush valve system is designed to replace standard flush valves and handles without the need for modification of the toilet tank or bowl. This invention provides the public with a simple and inexpensive device that allows the user to easily manage the amount of water dispensed per each flush while at the same time effectively providing for both solid and liquid waste flushes thus minimizing water consumption.

To achieve this, a flush valve system has been developed that is designed to utilize standard size flapper valves, seals and retainer nuts that are readily available at most plumbing retailers. It is preferably constructed of a single housing unit having at least two inlets affixed near the base of the tank fluidly connecting a single outlet. A flush handle assembly includes at least two handles mechanically connected to and at least two linkages. Both linkages pass through a sleeve assembly, which mounts in the standard mount hole provided on conventional gravity flush toilet tanks to provide effective control for the dual inlet flush valve. The inlets are sealed with a primary and a secondary flapper valve that are preferably connected by a chain or other link to the at least two linkages. The first (primary) flapper is preferably a reduced flow (water saving) flapper for use in flushing of liquid waste. The second (secondary) flapper is preferably a standard flapper for use in flushing solid waste or a combination of liquid and solid waste.

BRIEF DESCRIPTION OF THE DRAWINGS

A better understanding of the present invention will be had upon review of the detailed description of the preferred embodiment in connection with the drawings wherein like reference numerals refers to like parts throughout the drawings and wherein.

DETAILED DESCRIPTION OF A PREFERRED EMBODIMENT OF THE INVENTION

Figure 1:
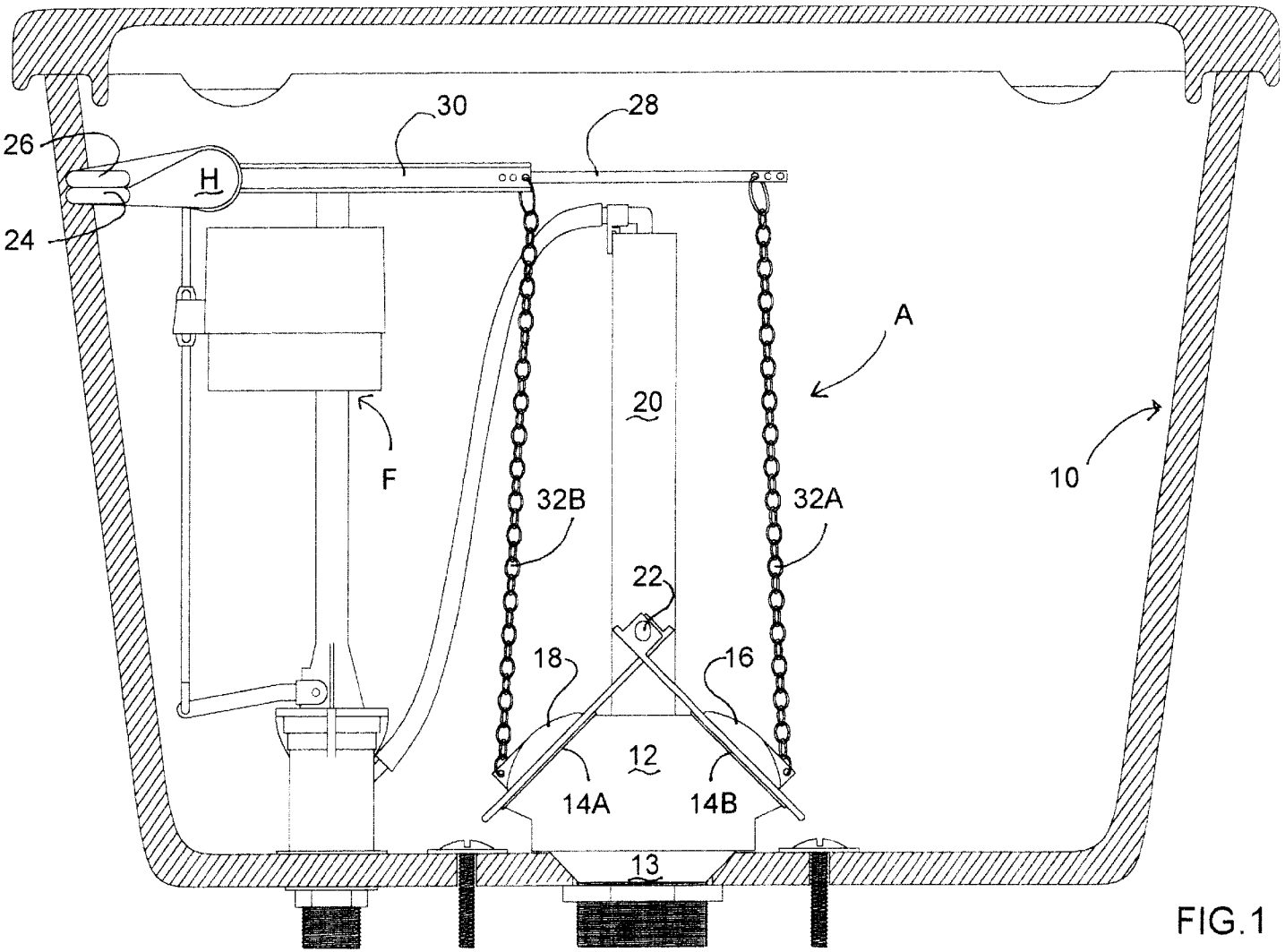
FIG. 1. is a cross-sectional view of a standard toilet tank including a preferred embodiment of an apparatus constructed in accordance with the present invention installed and connected to a conventional fill valve.

Referring now to FIGS. 1 through 9, and as best seen in FIG. 1, there is shown a cross-sectional view of an apparatus "A" constructed in accordance with the present invention positioned in a standard toilet tank 10. Preferably, the invention includes a housing 12 having at least two inlets 14*a* and 14*b* fluidly connecting at least one outlet 13. The inlets 14*a* and 14*b* are respectively sealed with a primary 16 and a secondary 18 flapper. Preferably, the primary flapper 16 is a reduced flow (water saving) flapper for use in flushing liquid waste. The secondary flapper 18 is preferably a full flow (standard) flapper for use in flushing solid waste or solid waste in combination with liquid waste.

Figure 2:
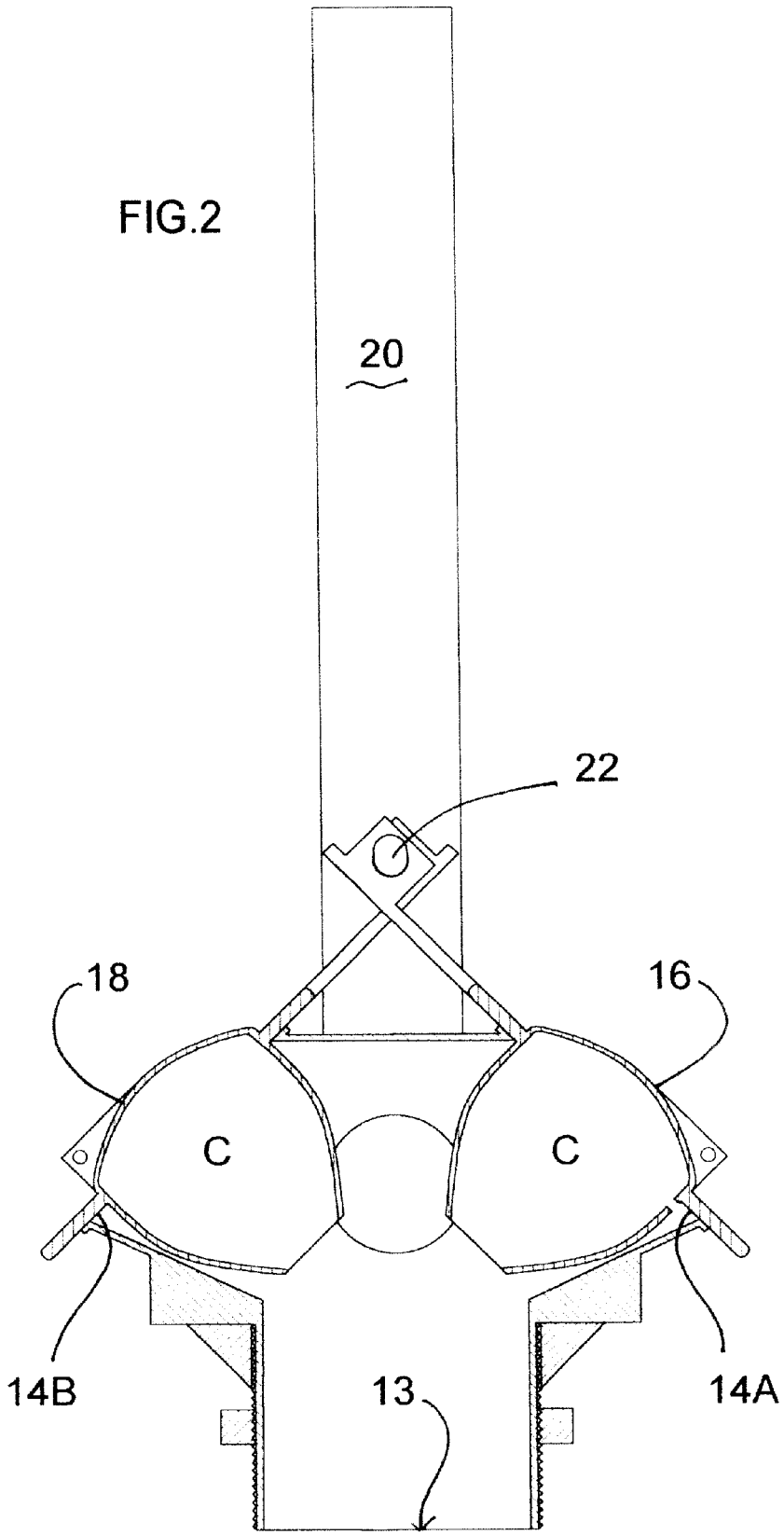
FIG. 2. is a cross-sectional view of the valve portion of an apparatus constructed in accordance with the present invention showing its various components.
Figure 3:
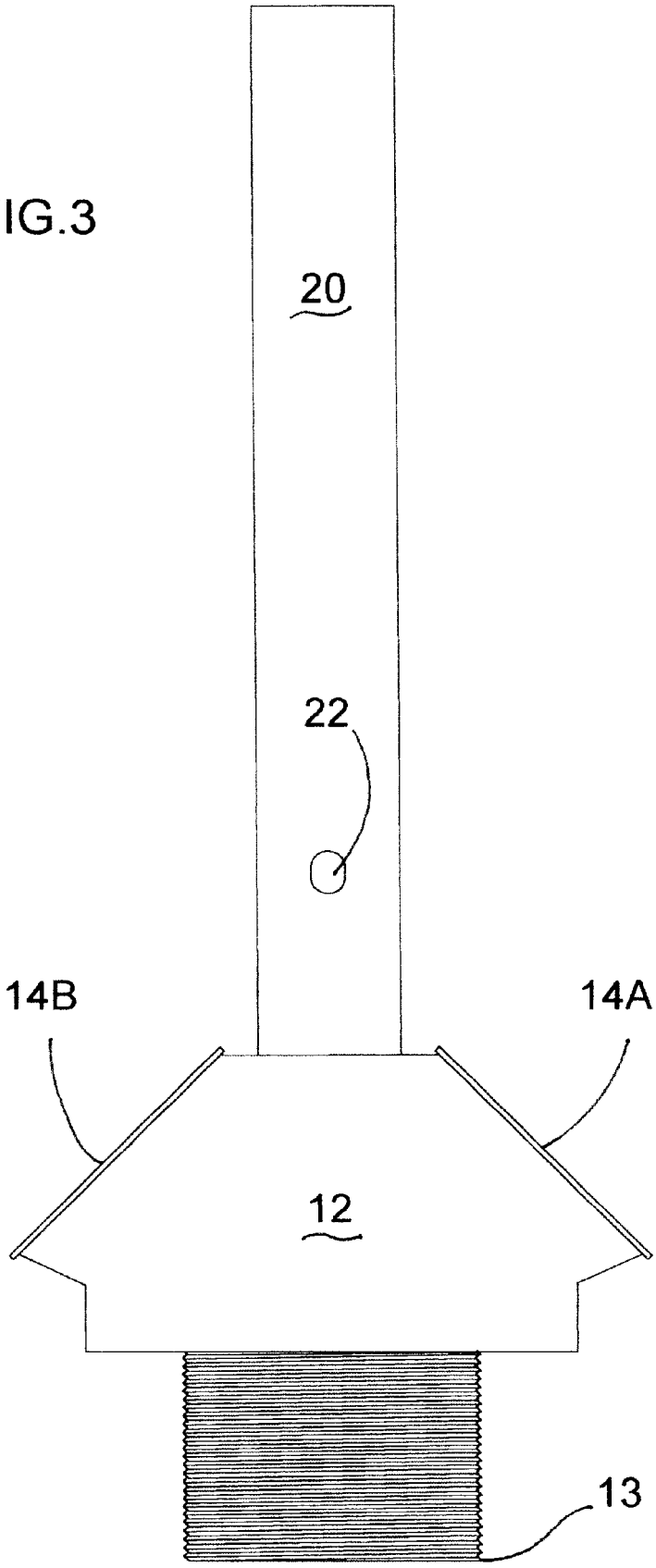
FIG. 3. is a cross-sectional view of a valve portion of an apparatus constructed in accordance with the present invention.
Figure 5:
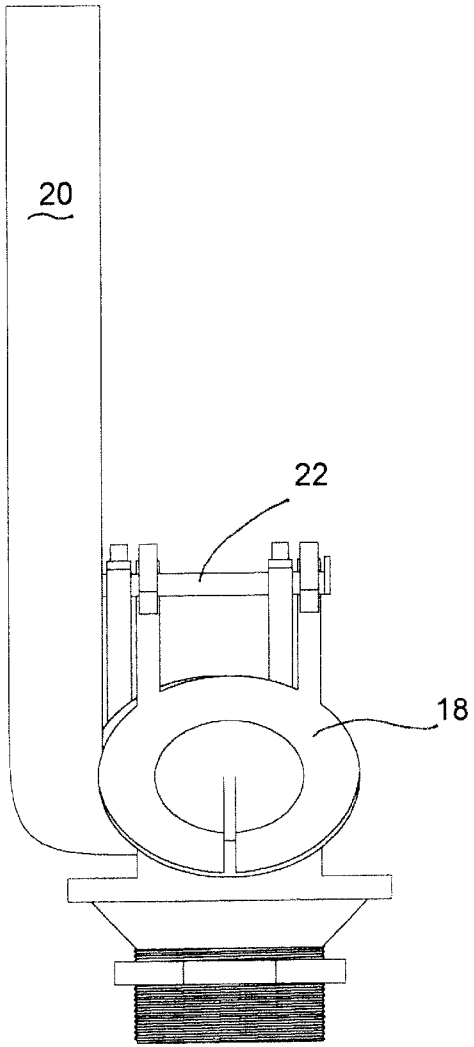
FIG. 5. shows a side view of the valve portion of an apparatus constructed in accordance with the present invention with the flappers, seal and retainer nut installed.
Figure 4:
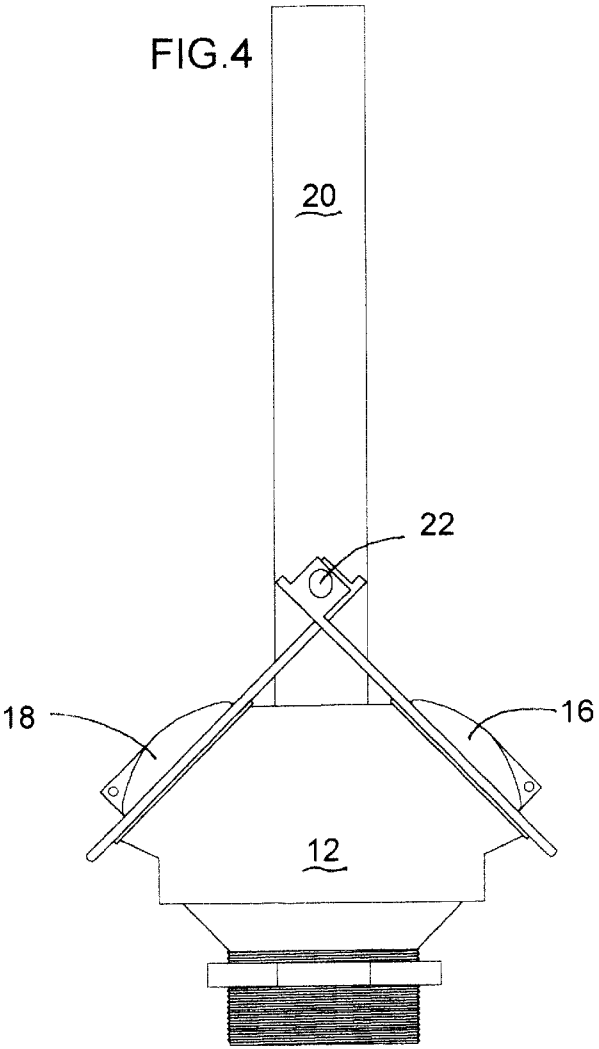
FIG. 4. shows a front view of the valve portion of an apparatus constructed in accordance with the present invention with flappers, seal and retainer nut installed.

Referring now to FIGS. 1–3, an overflow tube 20 is attached to the housing 12 that preferably extends upwardly to above water level. Preferably, the flappers 16 and 18 are pivotably connected to a flapper mount pin 22 provided on the overflow tube 20. Pivoting of either the primary 16 or secondary 18 flapper, or both of them, about the pin 22 orients the air chambers "C" of the flapper generally outward and opens its respective inlet 14*a* or 14*b*. Water is thus permitted to flow through the inlet 14*a* or 14*b* and the outlet 13 into the bowl even if the user immediately releases a handle connected to the flapper 16.

Figures 6, 7, 8:
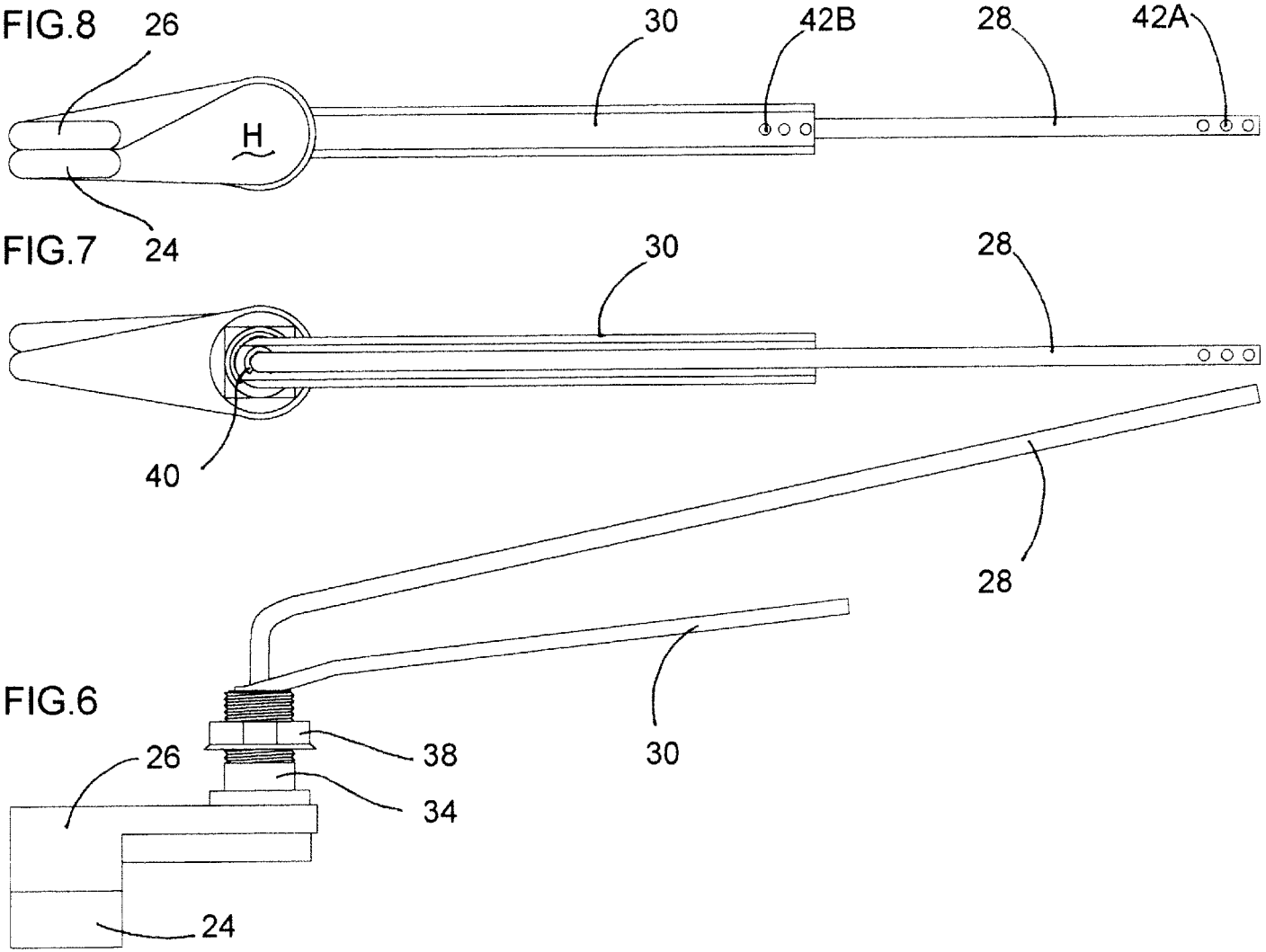
FIG. 6. shows a top view of the handle portion of an apparatus constructed in accordance with the present invention.
FIG. 7. shows a rear view of the handle portion of an apparatus constructed in accordance with of the present invention.
FIG. 8. shows a front view of the handle portion of an apparatus constructed in accordance with of the present invention; and, FIG. 9. shows a cross-sectional view of the handle portion of an apparatus constructed in accordance with the present invention.

Still referring to FIG. 1. and as best seen in FIGS. 6 through 8, there is shown a handle assembly "H" rotatably affixed on the outside of the tank 10. The assembly "H" preferably includes a primary 24 and a secondary 26 handle respectively connected to a primary 28 and a secondary 30 linkage. Preferably, the chains 32*a* and 32*b* connect the primary linkage 28 with the primary flapper 16 and secondary linkage 30 with the secondary flapper 18. As seen in FIG. 6, the primary handle 24 is preferably disposed below and extends outwardly from the tank 10 beyond the secondary handle 26.

Figure 9:
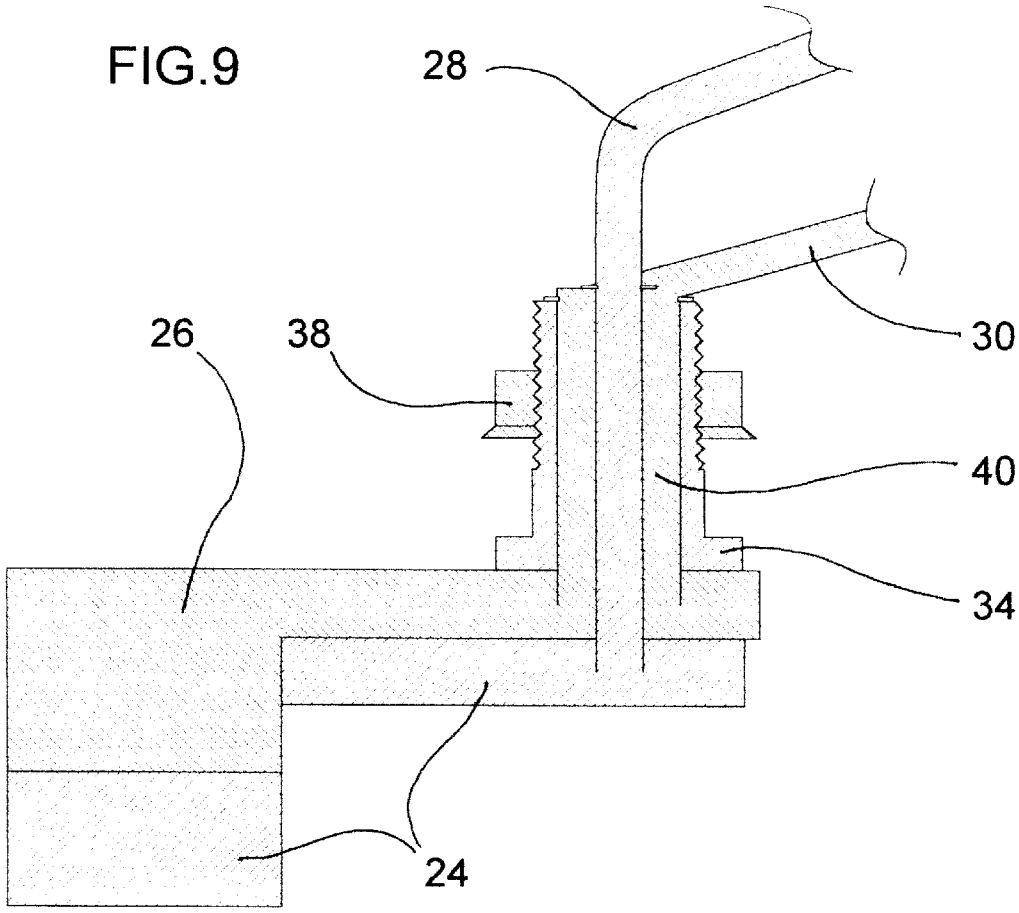

Referring now to FIGS. 6, 7 and 9, the linkages 28 and 30 pass through a sleeve assembly 34 mounted in a standard mount hole provided on the conventional gravity flush toilet tanks and are secured by a retainer nut 38. Preferably, the primary linkage 28 passes through an aperture 40 defined in the center of the secondary linkage 30. The flush linkages 28 and 30 extend out into the tank at staggered lengths so that they can be positioned over the flappers 16 and 18. The chains 32*a* and 32*b* are mounted to the linkages at holes 42*a* and 42*b* provided respectively on the linkages 28 and 30.

In operation, the handles 24 and 26 with linkages 28 and 30 work as levers. As the primary handle 24 is depressed, the attached linkage 28 rises and pulls, via the chain 32*a*, the primary flapper 16 upward to initiate a flush. As secondary handle 26 is depressed, the attached linkage 30 rises and pulls, via the chain 32*b*, the secondary flapper 18 upward to initiate a flush. Notably, in the preferred embodiment, the placement of the secondary handle 26 above the primary handle 24 results in the activation of the primary flush system whenever the secondary flush system is activated. However, it is anticipated that handles may be realigned (e.g., mounted in opposed fashion or in a non-overlapping arrangement) to permit greater selectivity in flushing. Alternatively, through modification of the linkages, a single standard flush handle may be used to operate the dual flush valve.

Preferably, a primary flush is initiated, when the handle 24 connected to the primary flapper 16 is depressed. This action causes the flapper 16 to rise up off its seal allowing tank water to drain through the inlet 14*a* of the housing 12, out the outlet 13 and then into the bowl. As the flapper 16 is preferably a reduced flow flapper, it descends to reseal inlet much more quickly than its standard counterpart but still permits a sufficient amount of water to produce a (short) liquid waste flush.

Preferably, a secondary flush is initiated when the handle 26 connected to the secondary flapper 18 is depressed. This action raises the flapper 18 up off its seal allowing tank water to drain through inlet 14*b* of the housing 12, out the outlet 13 and then into the bowl. As the flapper 18 is a standard type, it will stay open until the tank water drains to the point where the flapper is pulled down to its seal, thus producing a (long) solid waste flush.

A fill tube "F" which is well known in the art, connects to an overflow inlet and includes a ball cock valve or toilet fill valve to refill the bowl with standing water providing a trap seal and completing each flush.

Having thus described this preferred embodiment of the present invention, it is anticipated that various other embodiments will be become apparent to those having skill in the art that do not depart from the scope of the present invention.

I claim:

1. A dual flush system for a gravity flush toilet comprising:

a housing, said housing having a first and a second inlet and a outlet;

a first flapper valve sealingly engaging said first inlet, said first flapper valve comprising a reduced flow valve;

a second flapper valve sealing engaging said second inlet;

a handle assembly in communication with said first and second flapper valve, said handle assembly movable to a first orientation to selectively lift said first flapper valve from sealing engagement with said inlet to effectuate a first flush and movable to a second orientation to selectively lift said second flapper valve from sealing engagement with said second inlet to effectuate a second flush selectively simultaneously with said first flush.

2. The dual flush system of claim 1, wherein said handle assembly further comprises a first handle and a second handle.

3. The dual flush system of claim 1, wherein said handle assembly further comprises at least one linkage mounted to said handle assembly, said linkage having a first and a second chain securing said linkage to said first and second flapper valve.

4. A toilet system comprising in combination:

a toilet having a toilet tank; and a flush valve positioned in said toilet tank, said flush valve having a housing, said housing having a first end and a second end spaced apart from said first end, each of said ends including an inlet;

a reduced flow valve adapted to engage said inlet of said first end;

a standard flow flapper valve adapted to engage said inlet of said second end; and a handle assembly connected to said reduced flow valve and said flapper valve, said handle assembly being movable to a first orientation to operate said reduced flow valve and a second orientation to operate said reduced flow valve and said flapper valve.

5. The toilet system of claim 4, wherein said toilet tank further comprises a base and said inlet of said first end and said inlet of said second end are spaced equidistant above said base of said tank.

6. The dual flush system of claim 4, wherein said handle assembly comprises a primary handle connected to said reduced flow valve and a secondary handle connected to said flapper valve.

7. The dual flush system of claim 6, wherein said secondary handle is position above said primary handle such that operation of the secondary handle also operates said primary handle.

8. The dual flush system of claim 4, wherein said housing further comprises an overflow tube.

9. The dual flush system of claim 8, wherein said overflow tube further comprises a pivot pin for pivotably securing at least one of said reduced flow valve or said flapper valve to said overflow tube.

10. A dual flush system for a toilet comprising in combination:

a toilet having a toilet tank, said toilet tank having an undivided interior storage volume without any dividing walls, the interior storage volume containing a volume of fluid;

a housing positioned in said toilet tank having a first inlet and a second inlet and an outlet;

a reduced flow valve that engages said first inlet;

a flapper valve that engages said second inlet, said reduced flow valve and said flapper valve being spaced at approximately the same distance above said base of said tank;

a handle assembly connected to said reduced flow valve and said flapper valve, said handle assembly being movable to a first orientation to operate said reduced flow valve and a second orientation to operate said flapper valve;

wherein all of the fluid of said volume of fluid in said interior volume is in communication with both said reduced flow valve and said flapper valve when said reduced flow valve is engaged with said first inlet and said flapper valve is engaged with said second inlet.

11. The dual flush system of claim 10, wherein said handle assembly comprises a primary handle connected to said reduced flow valve and a secondary handle connected to said flapper valve.

12. The dual flush system of claim 11, wherein said secondary handle is position above said primary handle such that operation of the secondary handle also operates said primary handle.

13. The dual flush system of claim 10, wherein said housing further comprises an overflow tube.

14. The dual flush system of claim 13, wherein said overflow tube further comprises a pivot pin for pivotably securing at least one of said reduced flow valve or said flapper valve to said overflow tube.

15. A dual flush system for a gravity flush toilet comprising:

a housing, said housing having a first and a second inlet and an outlet;

a first flapper valve sealingly engaging said first inlet, said first flapper valve comprising a reduced flow valve;

a second flapper valve sealingly engaging said second inlet;

an overflow tube extending upwardly from said housing, said overflow tube having a pivot pin for pivotably securing said first and second flapper valves to said tube;

a handle assembly in communication with said first and second flapper, said handle assembly movable to a first orientation to selectively lift said first flapper valve from sealing engagement with said inlet to effectuate a first flush and movable to a second orientation to selectively lift said second flapper valve from sealing engagement with said second inlet to effectuate a second flush selectively simultaneously with said first flush.

16. The dual flush system of claim 15, wherein said handle assembly comprises a primary handle connected to said reduced flow valve and a secondary handle connected to said flapper valve.

17. The dual flush system of claim 15, wherein said handle assembly further comprises at least one linkage mounted to said handle assembly, said linkage having a first and a second chain securing said linkage to said first and second flapper valve.

18. A dual flush system for a gravity flush toilet having a tank with a base and volume of fluid contained therein, the fluid having a level that moves downwardly toward the base during a flush, the system comprising:

a housing positioned within the toilet tank, said housing having a first and a second inlet and an outlet;

a first flapper valve associated with said first inlet, said first flapper valve having an open position wherein said first inlet is uncovered and a closed position wherein said first flapper valve seals said first inlet, said first flapper valve comprising a reduced flow valve which moves from the open position to the closed position prior to the fluid level reaching said reduced flow valve during a flush;

a second flapper valve associated with said second inlet, said second flapper valve having an open position wherein said second inlet is uncovered and a closed position wherein said second flapper valve seals said second inlet, said second flapper valve comprising a standard flow valve which moves from the open position to the closed position when the fluid level reaches said standard flow valve during a flush; and a handle assembly in communication with said first and said second flapper valve, said handle assembly movable to a first orientation to selectively move said first flapper valve from the closed position to the open position to effectuate a first flush and movable to a second orientation to selectively move said second flapper valve from the closed position to the open position to effectuate a second flush.

19. The dual flush system according to claim 18, wherein said first inlet and said second inlet are spaced approximately equidistant above the base of the tank.

20. The dual flush system according to claim 18, wherein all of the volume of fluid in the toilet tank is in communication with both said reduced flow valve and said standard flow valve when both of said valves are in the closed position.

* * * * *